United States Patent [19]

Kiyooka et al.

[11] Patent Number: 4,746,274

[45] Date of Patent: May 24, 1988

[54] PORTABLE BLOWER

[75] Inventors: Katsumi Kiyooka; Akira Gaomh; Hideko Inomata, all of Tokyo, Japan

[73] Assignee: 501 Komatsu Zenoah Company, Japan

[21] Appl. No.: 78,401

[22] Filed: Jul. 27, 1987

Related U.S. Application Data

[62] Division of Ser. No. 882,590, Jul. 7, 1986.

[30] Foreign Application Priority Data

Jul. 10, 1985 [JP] Japan ..... 60-104026
Jul. 10, 1985 [JP] Japan ..... 60-104027
Jul. 10, 1985 [JP] Japan ..... 60-104028

[51] Int. Cl.[4] ..... F04B 17/00; F04B 35/00

[52] U.S. Cl. ..... 417/234; 417/364; 15/353; 15/405

[58] Field of Search ..... 417/364, 423 R, 234; 123/196 W, 195 HC, 198 E; 15/405, 327 F, 352, 353; 56/17.5, 16.7, 16.9

[56] References Cited

U.S. PATENT DOCUMENTS 1,606,424 11/1926 Irgens et al. ..... 123/196 W
2,284,141 5/1942 Funk ..... 417/423 R
2,529,362 11/1950 Allen ..... 417/423 R
3,037,582 6/1962 Egloff et al. ..... 123/196 W
3,829,250 8/1974 Samson, Jr. ..... 417/423 R
4,211,058 7/1980 Larsen ..... 56/17.5
4,223,419 9/1980 Sato et al. ..... 15/405
4,288,886 9/1981 Siegler ..... 15/344
4,318,203 3/1982 Satoh et al. ..... 417/364
4,461,055 7/1984 Zerrer et al. ..... 417/364
4,570,584 2/1986 Uetsuji et al. ..... 123/195 HC

FOREIGN PATENT DOCUMENTS 15633 1/1984 Japan ..... 123/198 E
2042075 9/1980 United Kingdom ..... 417/364

*Primary Examiner*—Carlton R. Croyle
*Assistant Examiner*—Donald E. Stout
*Attorney, Agent, or Firm*—Wolf, Greenfield & Sacks

[57] ABSTRACT

There is provided a portable blower. The portable blower comprises a casing including an engine chamber and a fan chamber. The engine chamber accommodates an engine, and the fan chamber a fan. The engine comprises an engine cylinder, a crankcase, a cantilever-type crank shaft, a carburetor, and a muffler, in which the crankcase is disposed in front of the engine cylinder, the crank shaft extending downwardly from the crankcase into the fan chamber, the carburetor being disposed above the crankcase and connected thereto, the muffler being disposed above the engine cylinder and connected thereto, and the fan being fixed to a lower end of the crank shaft and driven by the engine to suck air from atmosphere and blow air to atmosphere.

12 Claims, 30 Drawing Sheets

PORTABLE BLOWER

This patent application is a division of our earlier application Ser. No. 882,590, now allowed, which was filed in the U.S. Patent And Trademark Office on July 7, 1986.

BACKGROUND OF THE INVENTION

1. Field of the Invention

The present invention relates to a portable blower, and particularly to a portable blower having a vertical rotary shaft which is driven by an engine and provided at its lower end with a fan to blow or suck the dust such as fallen leaves on the ground by the blowing force or the sucking force of the fan.

2. Description of the Prior Art

In a prior art portable blower, an engine cylinder is horizontally disposed, and, on both sides of the engine cylinder a carburetor and a muffler are arranged respectively. Due to this arrangement, a width of the blower is elongated to bother an operator. For instance, when the blower is hung from a shoulder of the operator by a shoulder belt, the blower will hit the waist or the thigh of the operator to hinder the handling of the blower.

An air filter is usually disposed at a suction mouth of a fan of the blower to prevent the dust from entering into the blower. In the blower of a type which cools its engine by using a part of air sucked by the fan to blow the dust, the engine tends to overheat if the air filter is clogged by the dust to reduce the airflow.

Whenever the blower is used for blowing the dust on the ground, a blower pipe shall be attached to the discharge mouth of blower, and the blower pipe shall be removed from the blower and stored every time after the blowing work is finished. This operation of assembling and disassembling of the blower pipe is bothersome in the prior art blower.

When the blower is used for sucking the dust on the ground, a dust collecting unit shall be attached to the blower. Since the dust collecting unit is relatively bulky and heavy, it is bothersome to handle the dust collecting unit in the prior art blower.

The portable blower may be used selectively for blowing the dust and for sucking the dust. Whenever the blowing operation and the sucking operation is changed, a blower pipe of the blower shall be changed from a discharge mouth to a suction mouth of the blower or vice versa. This changing operation is bothersome for an operator.

If an operator wants to blow and suck the dust on the ground simultaneously, the prior art does not provide a suitable blower which can perform conveniently the simultaneous blowing and sucking operation.

Further, the prior art portable blower is generally provided with projections which are used for hooking a shoulder band. When the shoulder band is not required, the projections tend to catch clothes of an operator of the blower to bother the operator.

In prior art portable blower, an air filter provided for a carburetor is generally attached to and removed from the carburetor in a direction of an airflow, i.e., a direction perpendicular to a plane of the air filter. If it is required in the portable blower to arrange the carburetor above a crankcase and arrange a grip handle over the carburetor, the space for inserting and removing the air filter for the carburetor is very limited to make it difficult to clean or replace the air filter.

SUMMARY OF THE INVENTION

An object of the present invention is to provide a compact portable blower having a vertical rotary shaft, a carburetor disposed on a crankcase, and a muffler disposed on an engine cylinder.

Another object of the present invention is to provide a portable blower which engine is properly be cooled.

A third object of the present invention is to provide a portable blower which blower pipe can conveniently be handled.

A fourth object of the present invention is to provide a portable blower which can use both for blowing and sucking the dust.

A fifth object of the present invention is to provide a portable blower which hooking portions for hooking a shoulder band do not project outwardly from a body of the blower.

A sixth object of the present invention is to provide a portable blower which air filter for a carburetor can easily be replaced.

The other object of the present invention is to provide a portable blower which can be used for blowing the dust and for sucking the dust without changing a blower pipe of the blower.

BRIEF DESCRIPTION OF THE DRAWINGS

These and other objects, features and advantages of the present invention will become apparent from the following descriptions of preferred embodiments taken in conjunction with the accompanying drawings in which.

DETAILED DESCRIPTION OF THE EMBODIMENTS

Figure 1:
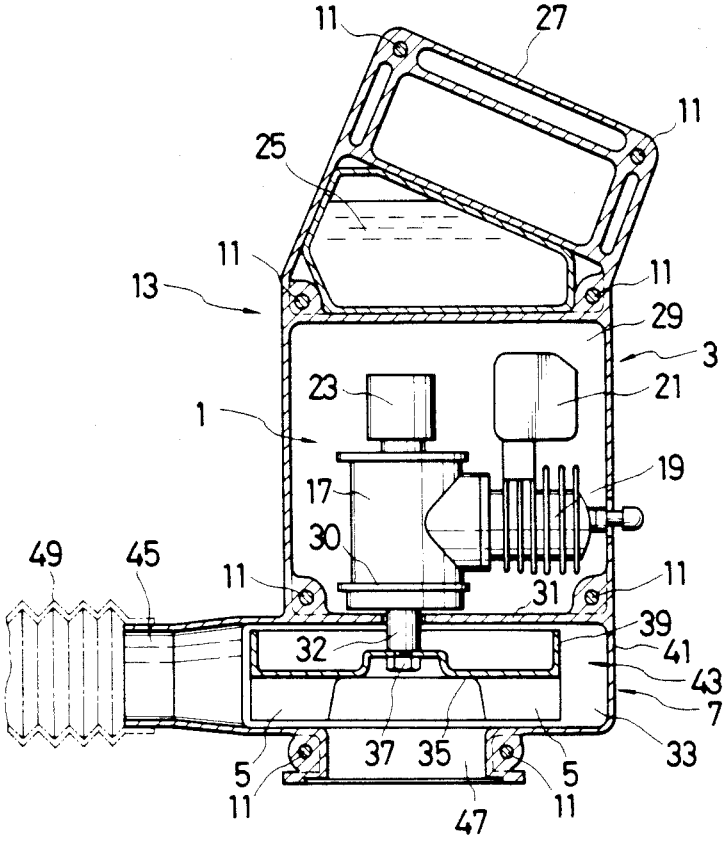
FIG. 1 is a cross-sectional side view showing a portable blower according to a first embodiment of the present invention.

The details of the present invention will now be described in the way of embodiments with reference to the drawings. Like numerals represent like parts through the drawings.

A first embodiment of the present invention will be described with reference to FIGS. 1 to 4.

An engine 1 is enclosed in an engine casing 3, and a blower fan 5 in a fan casing 7. The casings 3 and 7 are formed solidly by synthetic resin to form a casing 13 comprising a right half and a left half which are assembled along a vertical plane 9 including a center line and fixed by screws 11. A crankcase 17 has a vertical crank shaft 15 and is fixed to an engine cylinder 19 which is arranged at the back of the crankcase 17. A muffler 21 is disposed above the engine cylinder 19 and communicates therewith. A carburetor 23 is disposed above the crankcase 17 and communicates therewith. A fuel tank 25 having a filler mouth 24 is arranged at an upper part of the engine casing 3. A handle 27 is located above the fuel tank 25 and is formed solidly with the engine casing 3. A partition wall 31 is formed at a bottom of an engine chamber 29 formed in the engine casing 3. Below the partition wall 31, a fan chamber 33 is formed in the fan casing 7. A rotary shaft 32 is connected with the crank shaft 15 through a centrifugal clutch 30 and extends through the partition wall 31. A disk-like rotary plate 35 which is provided with the blower fan 5 is fixed to a lower end of the rotary shaft 32 by means of a nut 37. The blower fan 5 comprises a plurality of radial blades formed on a lower surface of the rotary plate 35. An annular wall 39 is fixed to a periphery of the rotary plate 35 and extends upwardly.

Figure 4:
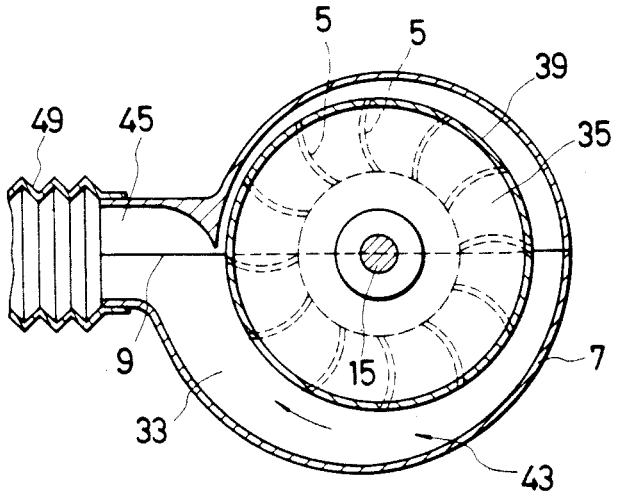
FIG. 4 is a cross-sectional plan view showing a spiral air passage of the blower.

A spiral air passage 43 is formed between a peripheral wall 41 of the fan casing 7 and the annular wall 39. Cross-sectional areas of the spiral air passage 43 increase sequentially in a rotational direction of the rotary plate 35 as shown in FIG. 4 to communicate with a discharge mouth 45 located at the front of the fan casing 7. In the center of a lower surface of the fan casing 7, a suction mouth 47 is opened. A blower pipe (not shown) will be fitted to the discharge mouth 45 through a flexible pipe 49.

Figure 2:
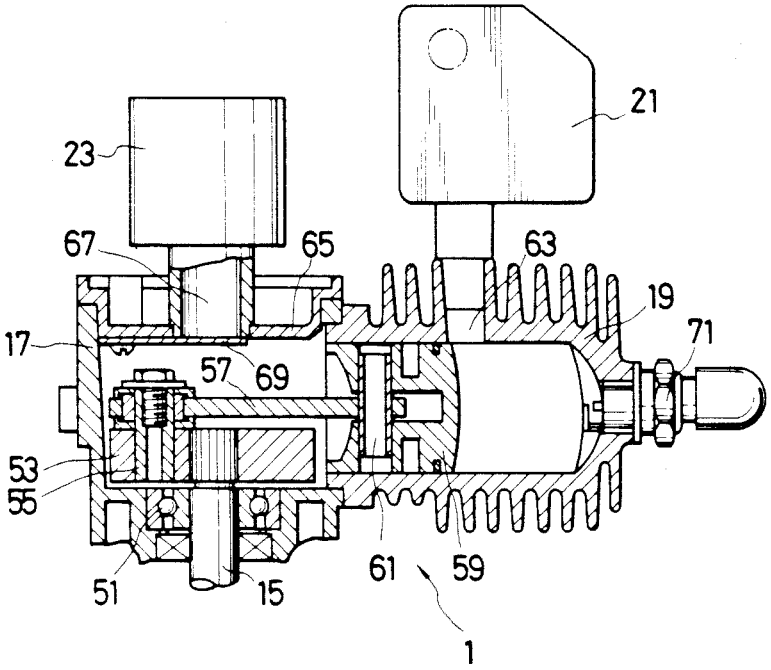
FIG. 2 is an enlarged view showing an engine portion of the blower.
Figure 3:
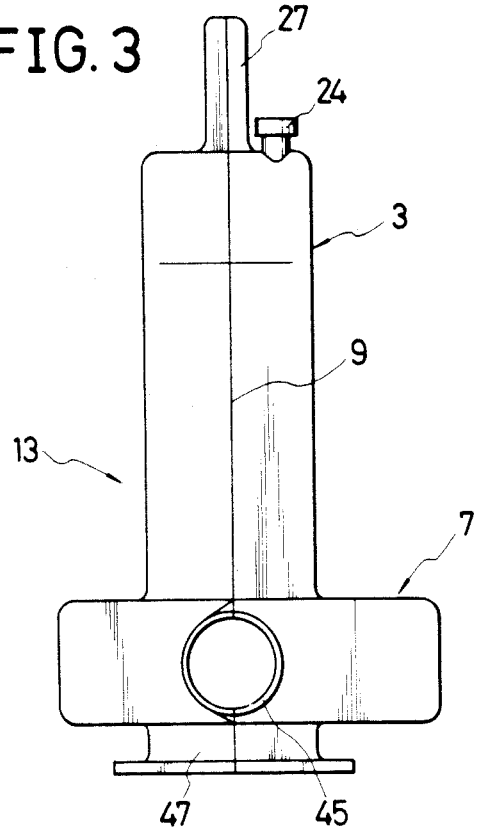
FIG. 3 is a front view showing the blower.

A constitution of the engine 1 will be described with reference to FIG. 2.

The crank shaft 15 is vertically supported by a bearing 51 at a lower part of the crankcase 17. At an upper end of the crank shaft 15 in the crankcase 17, a crank arm 53 is fixed. A crank pin 55 projects upwardly through the crank arm 53 and is connected with one end of a piston rod 57 which is pivotal around the crank pin 55. The other end of the piston rod 57 is connected with a piston 59, which is freely slidable in the engine cylinder 19, through a piston pin 61. The muffler 21 is fixed to the upper part of engine cylinder 19 and communicates with an exhaust port 63 which is located at the upper part of engine cylinder 19. An upper opening portion of the crankcase 17 is covered by a cap portion 65 through which a suction port 67 extends. The carburetor 23 is fixed to the suction port 67 which is provided at its lower end with a check valve 69 which opens downwardly. On top of the cylinder 19, an ignition plug 71 is provided.

In operation, air is sucked through the suction mouth 47, sent through the spiral air passage 43 by the blower fan 5, passed through the discharge mouth 45, and blown from a front end of the blower pipe. An operator will carry the casing 13 by the handle 27 with one hand, and the blower pipe with the other hand to blow the dust on the ground to collect the dust.

According to the above arrangement of the present invention, a compact portable blower which does not bother an operator who carries the blower is realized.

Although the embodiment has been explained as a blower to blow the dust on the ground, it may be used as a dust collector in which a dust collecting case may be attached to the suction mouth 47 to collect the dust on the ground by using the sucking force of blower fan 5.

The centrifugal clutch 30 may be omitted, and the crank shaft 15 can be connected directly to the rotary plate 35.

A second embodiment of the present invention will be described with reference to FIG. 5. This embodiment relates to a cooling system of the engine 1.

A disk-like rotary plate 35' is fixed to the lower end of rotary shaft 32 which extends through the partition wall 31. In addition to a blower fan 102 comprising a plurality of blades formed on a lower surface of the rotary plate 35', the rotary plate 35' is provided with a cooling fan 101 which comprises a plurality of blades formed on an upper surface of the rotary plate 35'. A periphery of the rotary plate 35' is curved upwardly. The peripheral wall 41 of fan chamber 33 is formed in a spiral shape which crosssectional areas are sequentially enlarged in a rotational direction of the rotary plate 35' to form the spiral air passage 43 between an inner surface of the peripheral wall 41 and the peripheries of blades of the cooling fan 101 and blower fan 102. A partition wall 103 extends from an inner surface of the peripheral wall 41 to the vicinity of the periphery of rotary plate 35' to separate the spiral air passage 43 into a cooling air passage 104 and a working air passage 105. An air suction hole 106 is provided on the front side of the engine casing 3 to provide communication between atmosphere and the engine chamber 29. An air suction hole 107 is formed near the center of partition wall 31 on the air suction hole 106 side, and an air supply hole 108 is formed on the periphery of partition wall 31 facing the engine cylinder 19. An air discharge hole 109 is formed at a proper location on the engine casing 3 such that air from the air supply hole 108 will cool the engine cylinder 19 and be discharged through the air discharge hole 109. The working air passage 105 communicates with the discharge mouth 45. The suction mouth 47 is provided with a filter 110 and opened in the center of fan chamber 33.

Upon the activation of engine 1, air is sucked by the blower fan 102 through the filter 110, and discharged from the discharge mouth 45 through the working air passage 105. On the other hand, air which enters into the engine chamber 29 through the hole 106 is sucked by the cooling fan 101 through the hole 107, supplied again into the engine chamber 29 through the hole 108, cools the periphery of engine cylinder 19, and is discharged outside through the hole 109. If the filter 110 is clogged, airflow in the working air passage 105 may be decreased, but the rotation of engine 1 will not be decreased so that airflow caused by the cooling fan 101 may not be decreased. As a result, the engine 1 will continuously be cooled to prevent the engine 1 from burning. Since the periphery of rotary plate 35' is curved upwardly, the airflow caused by the cooling fan 101 will be sent toward the hole 108, but not sent toward the working air passage 105 to decrease the cooling airflow.

Due to the above arrangement, even if the filter 110 is clogged, the engine 1 will continuously and properly be cooled to prevent the engine from burning.

A third embodiment will be described with reference to FIG. 6. This embodiment relates to a modification of the cooling fan 101 shown in FIG. 5.

An annular side plate 111 is fixed to lower ends of the blades of blower fan 102. An auxiliary fan 112 comprising a plurality of blades which are radially formed on the annular side plate 111 and between the annular side plate 111 and a bottom wall 113 of the fan chamber 33 which faces the annular side plate 111.

In operation, air which escapes from the working air passage 105 to the suction mouth 47 through a gap between the annular side plate 111 and the bottom wall 113 is pushed back by the rotation of auxiliary fan 112 so that an air blowing efficiency will not be decreased.

Figure 7:
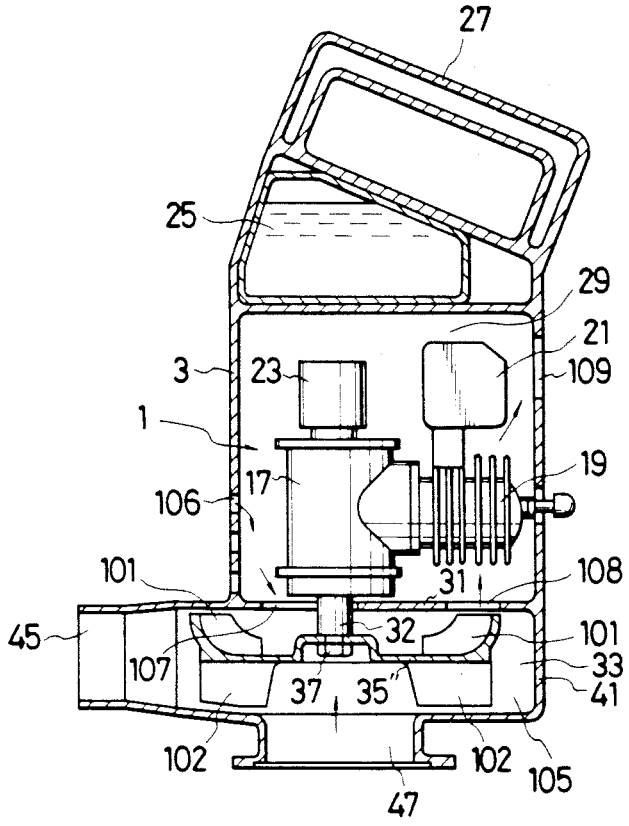
FIG. 7 is a cross-sectional side view showing a portable blower according to a fourth embodiment of the present invention.

A fourth embodiment of the present invention will be described with reference to FIG. 7. This embodiment relates to a modification of the rotary plate 35' shown in FIG. 5.

Figure 5:
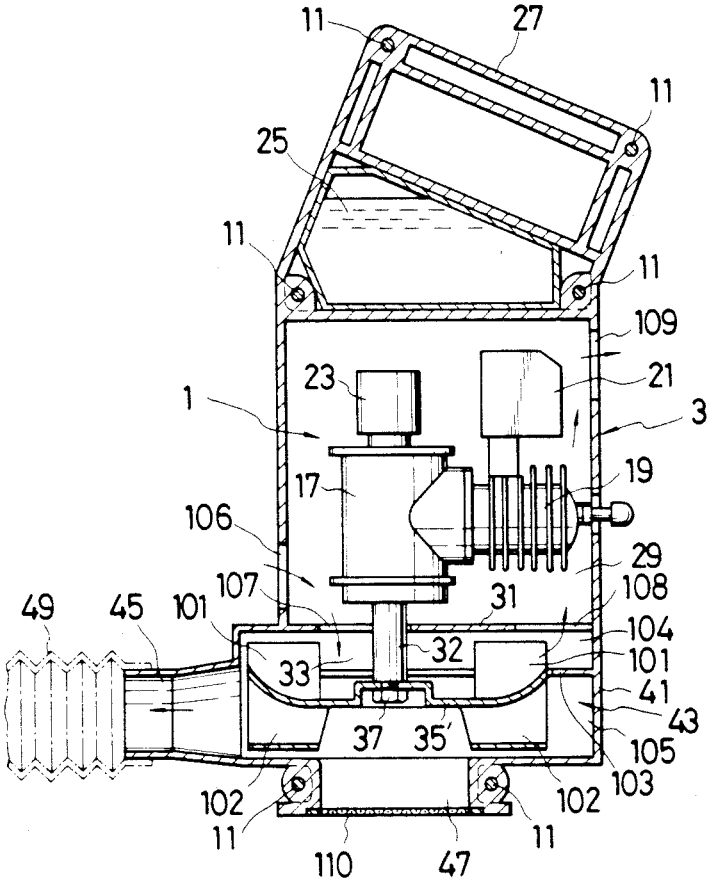
FIG. 5 is a cross-sectional side view showing a portable blower according to a second embodiment of the present invention.
Figure 6:
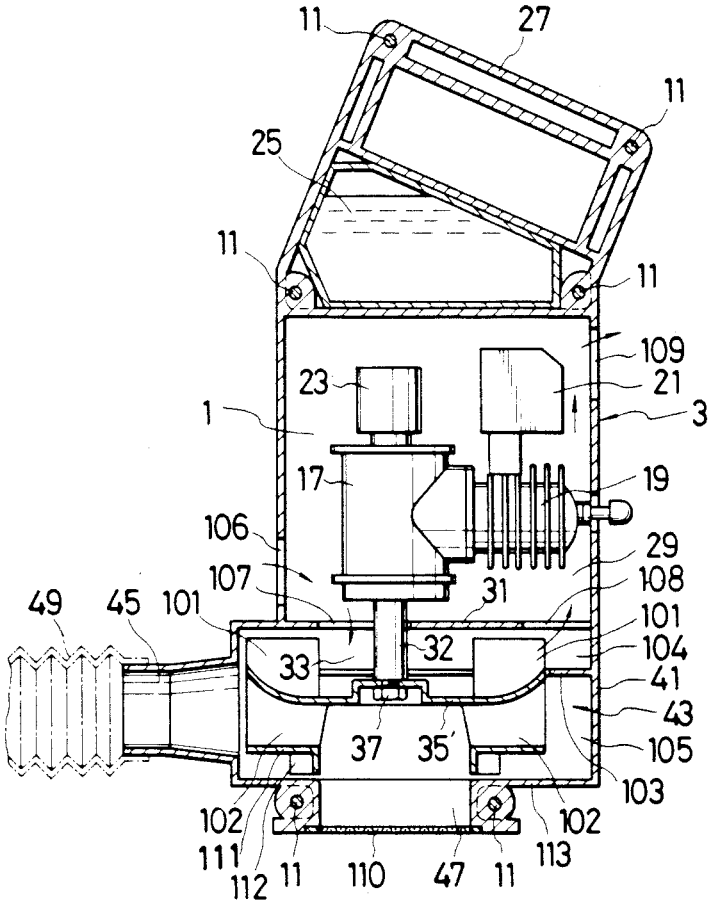
FIG. 6 is a cross-sectional side view showing a portable blower according to a third embodiment of the present invention.

A difference between the fourth embodiment and the third embodiment is that a periphery of a rotary plate 35'' of the fourth embodiment is extended upwardly to the vicinity of the partition wall 31, and the partition wall 103 shown in FIG. 5 is omitted. The air supply hole 108 formed on the partition wall 31 shall be located inside the peripheral end of the rotary plate 35''.

Figure 8:
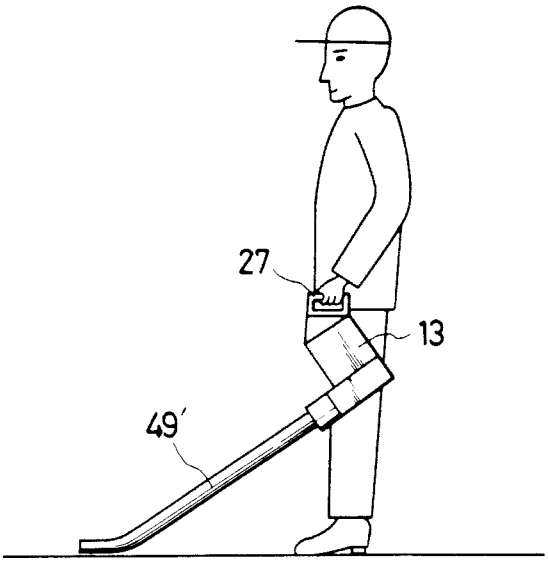
FIG. 8 is a general view showing a portable blower according to a fifth embodiment of the present invention.

A fifth embodiment of the present invention will be described with reference to FIG. 8.

A rigid blower pipe 49' instead of the flexible pipe 49 is removably fitted to the discharge mouth 45. A front end of the blower pipe 49' is formed such that, when the handle 27 is carried by a hand, the blower pipe 49' is inclined downwardly, and the front end of blower pipe 49' is horizontal in parallel with the ground. In this using state, the blower is designed such that a couple of force caused around the handle 27 by a total weight of the blower and a couple of force caused around the handle 27 by a reaction force of air blown from the end of blower pipe 49' are balanced. Namely, the front end of blower pipe 49' is balanced at a position adjacent to the ground, when the handle 27 is carried by a hand.

According to the above arrangement, air is blown horizontally out of the end of blower pipe 49' to realize an efficient blowing operation. Even if the ground is soft, the soil will not be blown out by the blowing air, because the air is blown horizontally. It is possible to enlarge a slant angle of the blower pipe 49' being held by a hand to shorten a length of the blower pipe 49'.

Figure 9:
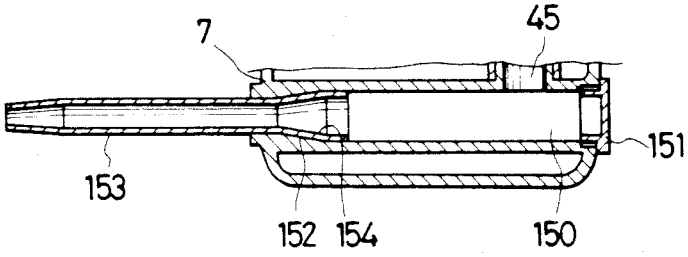
FIG. 9 is a cross-sectional plan view showing an essential portion of a portable blower according to a sixth embodiment of the present invention.

A sixth embodiment will be described with reference to FIG. 9.

A cylindrical storage chamber 150 is provided besides the fan casing 7. The discharge mouth 45 is formed to open at a rear end portion of the storage chamber 150. A cap 151 is screwed removably to a rear end of the storage chamber 150. A conical surface 152 is formed at a front end of the storage chamber 150. Diameters of the conical surface 152 increase from the front end of storage chamber 150 toward the depth of storage chamber 150. A blower pipe 153 is provided at its rear end a conical surface 154 corresponding to the conical surface 152 of the storage chamber 150. The blower pipe 153 is stored in the storage chamber 150 when the blower pipe 153 is not used. To use the blower pipe 153, it is pulled out of the storage chamber 150, and the conical surfaces 152 and 154 are engaged tightly with each other.

Figure 10:
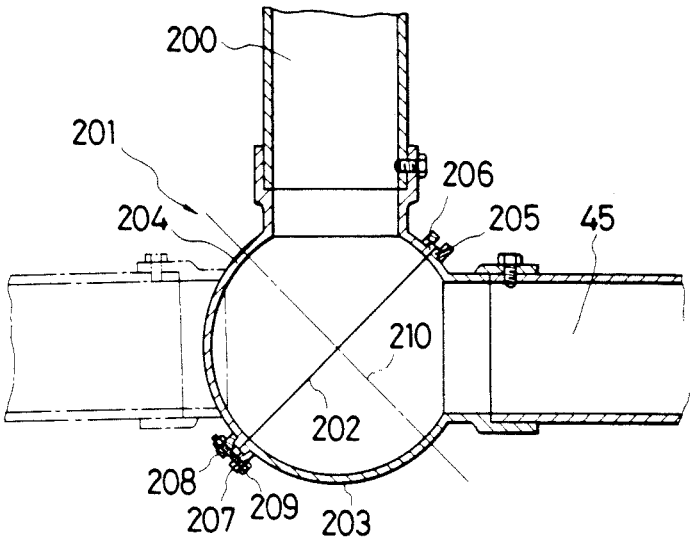
FIGS. 10 and 11 are cross-sectional side views showing essential portions of a portable blower according to a seventh embodiment of the present invention and its modification respectively.

A seventh embodiment of the present invention will be described with reference to FIG. 10. A blower pipe 200 is connected to the discharge mouth 45 via a connecting member 201. The connecting member 201 is divided along a plane 202 into a fixed portion 203 and a pivotal portion 204. The plane 202 is inclined by 45 degrees. The fixed portion 203 is fixed to a periphery of the discharge mouth 45. The pivotal portion 204 is fixed to the blower pipe 200. The fixed portion 203 and the pivotal portion 204 are fitted together by circular flange portions 205 and 206 which are formed on the portions 203 and 204 respectively along the plane 202. Annular members 207 and 208 are disposed around the flange portions 205 and 206 respectively and fastened by a bolt 209 to hold the fixed portion 204 and the pivotal portion 204 together. In this assembled state, the pivotal portion 204 is pivotal with respect to the fixed portion 203 around a slanted axis 210. The blower pipe 200 is fixed to the pivotal portion 204 by an angle of 45 degrees with respect to the axis 210. The blower pipe 200 can pivot around the axis 210 from a storing position indicated by a continuous line shown in FIG. 10 to a blowing position indicated by a dotted line shown in the same figure.

Figure 11:
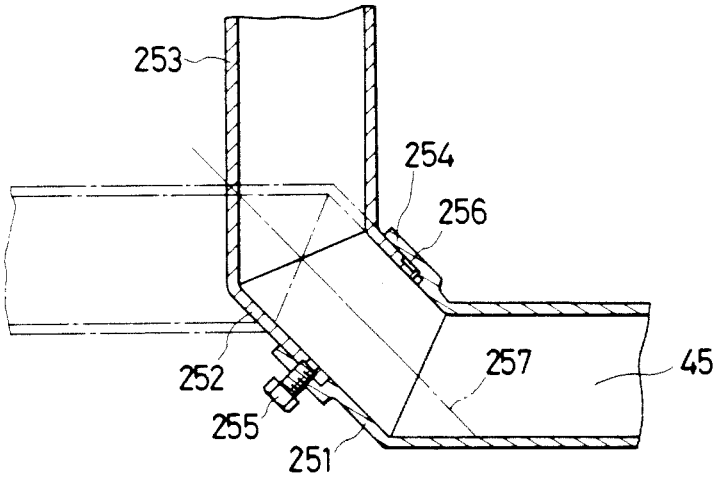

FIG. 11 shows a modification of the seventh embodiment.

A cylindrical fixed portion 251 is formed integrally with the discharge mouth 45, and a cylindrical pivotal portion 252 is formed integrally with a rear end of a blower pipe 253. An end of the pivotal portion 252 is inserted pivotally into a cylindrical end 254 of the fixed portion 251. A screw 255 passes through the cylindrical portion 254 and engages with a groove 256 formed on the periphery of pivotal portion 252 to prevent the pivotal portion 252 from escaping. The blower pipe 253 can pivot around an axis 257 from a storing position indicated by a continuous line shown in FIG. 11 to a blowing position indicated by a dotted line shown in the same figure.

An eighth embodiment of the present invention will be described with reference to FIGS. 12 and 13. In this embodiment, the blower is used for sucking the dust on the ground.

A dust collecting case 301 is removably connected to the suction mouth 47 by a screw 302. The dust collecting case 301 has an opening at its bottom end and is connected with a dust suction pipe 303 through a flexible pipe 304. An opening of an impermeable dust collecting bag 305 such as a vinyl bag is tightly attached to a lower end of the dust collecting case 301 with a fitting band 306. A supporting frame 307 is inserted inside the dust collecting bag 305 and fixed to the lower part of dust collecting case 301. A guide plate 308 is arranged inside the dust collecting base 301 to guide downwardly air sucked through the dust suction pipe 303. At an upper part of the dust collecting case 301, there is formed a filter chamber 309 facing the suction mouth 47. Vent holes 310 are provided around the filter chamber 309. A porous filter 311 surrounds the vent holes 310.

In operation, the blower fan 5 is rotated according to the rotation of the engine 1. An operator carries the casing 13 by the handle 27 with one hand, and with the other hand grasps the dust suction pipe 303 to suck the dust on the ground from a front end of the dust suction pipe 303. The dust with air enters into the dust collecting bag 305 and is collected in the bag. Small dust is separated by the filter 311. Air in the bag 305 is sucked by the blower fan 5 and discharged from the discharge mouth 45 through the spiral air passage 43. Even if a negative pressure is caused in the bag 305, the bag will not be deformed largely because the bag 305 is supported by the supporting frame 307.

The supporting frame 307 may be formed in a cylindrical shape. The bottom of dust collecting case 301 will be open, and the dust collecting bag 305 can surround the periphery of a side wall of the dust collecting case 301 can be fastened thereto. In this case, a rubber cover, etc., may be provided to cover the bottom of dust collecting bag 305. The opening of dust collecting bag 305 around the dust collecting case 301 may be fastened by a string, and a groove may be formed on the dust collecting case 301 at a position where the string is fastened. The filter chamber 309 may be filled with a filtering material to pass air from the dust collecting case 301 to the suction mouth 47 through the filter chamber 309.

Figure 12:
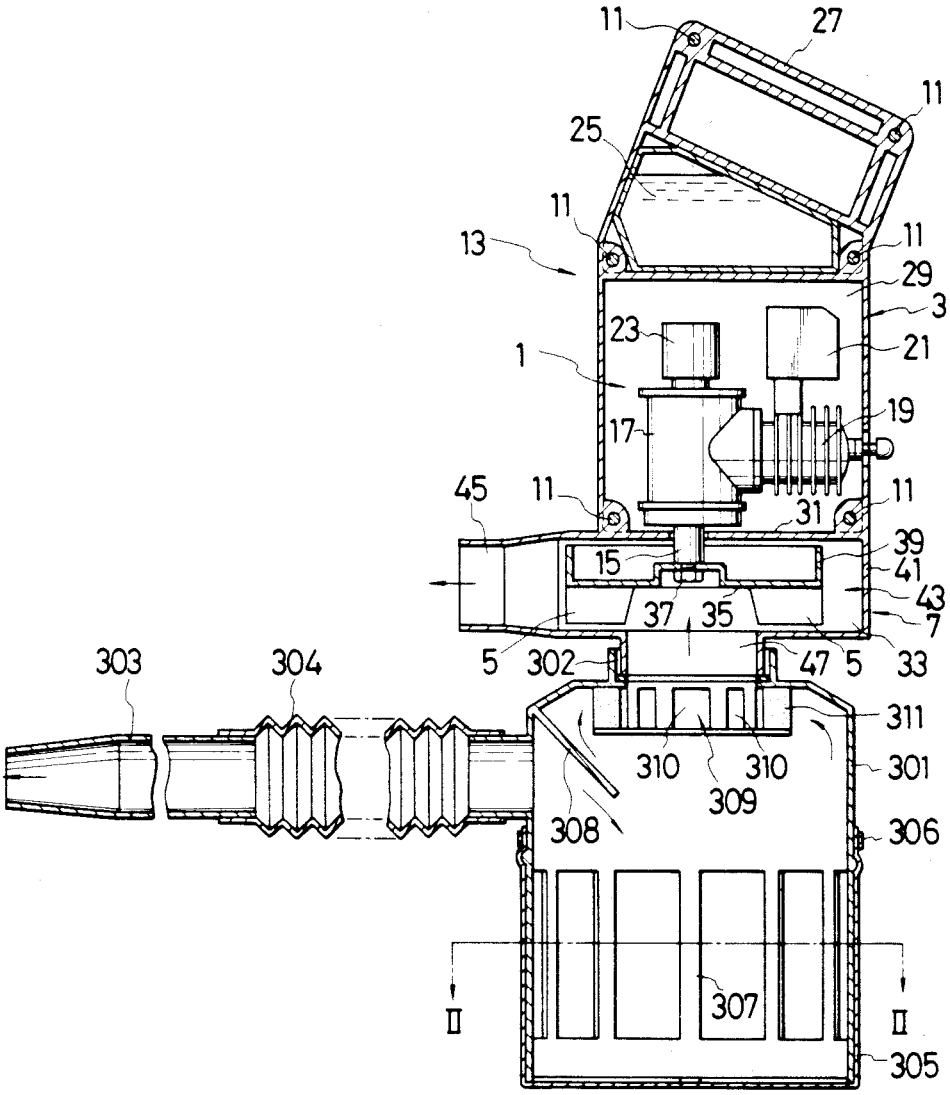
FIG. 12 is a cross-sectional side view showing a portable blower according to an eighth embodiment of the present invention.
Figure 13:
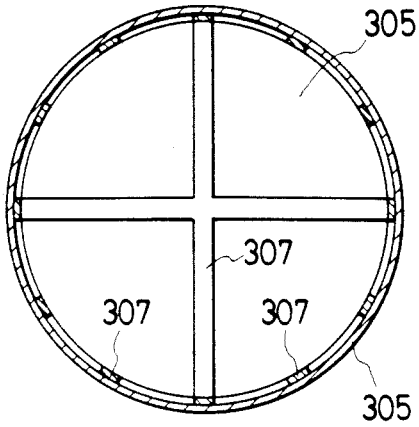
FIG. 13 is a cross-sectional plan view taken along the line II—II shown in FIG. 12.
Figure 14:
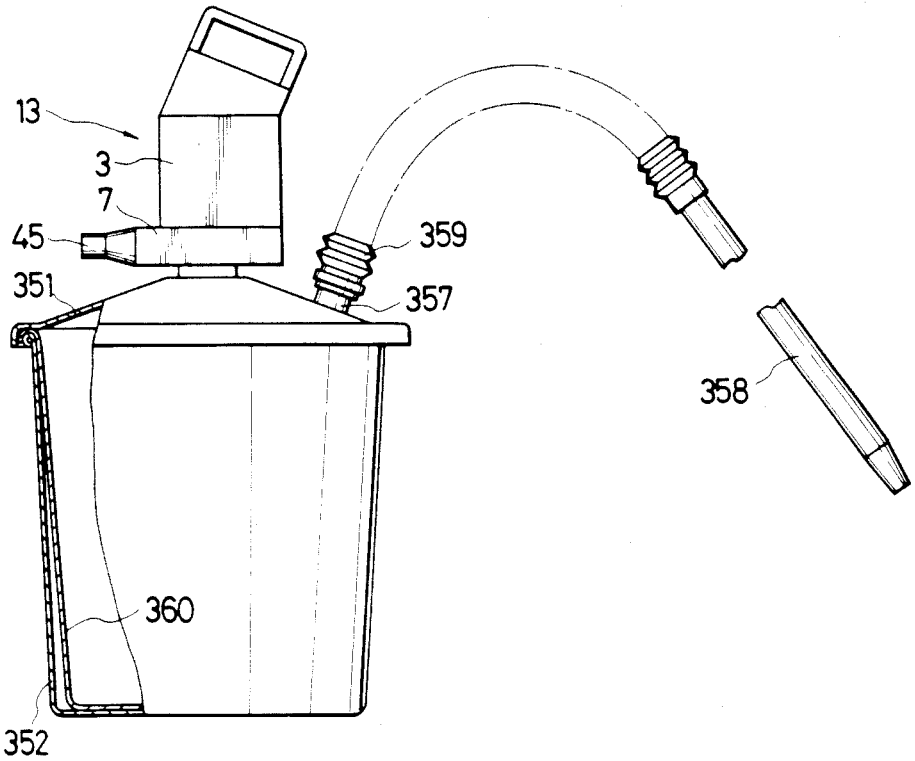
FIGS. 14 to 21 are views showing modifications of the eighth embodiment.
Figure 15:
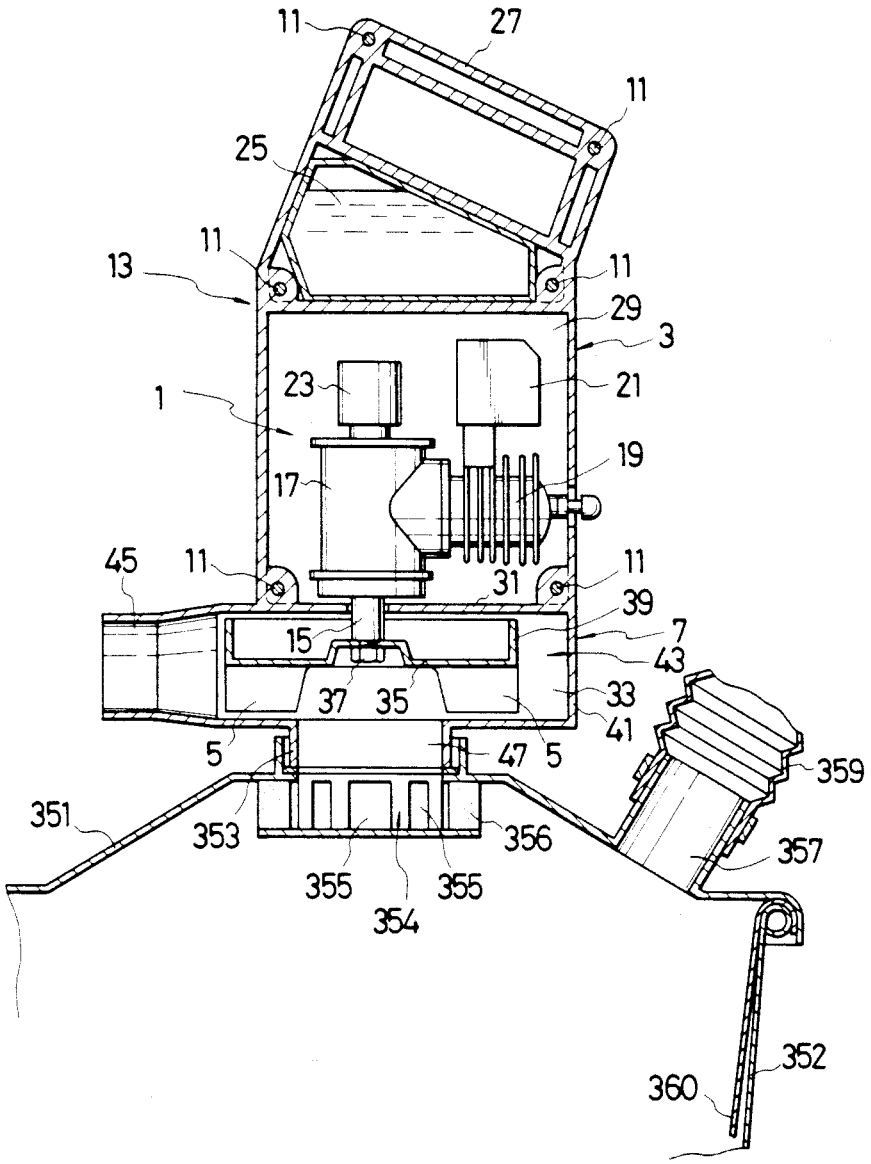

FIGS. 14 and 15 show a modification of the eighth embodiment, particularly a modification of the dust collecting case 301 shown in FIG. 12.

A cap portion 351 of a dust collecting case 352 is fixed to the suction mouth 47 by a screw 353. A filter chamber 354 of the cap portion 351 has an opening which faces the suction mouth 47. Vent holes 355 are provided around the filter chamber 354. An annular filter 356 is disposed around the vent holes 355. A suction pipe 357 projects outwardly from the cap portion 351. A dust suction pipe 358 is connected to the suction pipe 357 through a flexible pipe 359. A dust collecting bag 360 made of permeable material is inserted into the dust collecting case 352. An edge of an opening of the dust collecting bag 360 is held between an upper edge of the dust collecting case 352 and the cap portion 351. The dust collecting bag 360 may be made of impermeable material such as a vinyl sheet to which vent holes are properly formed.

Figure 16:
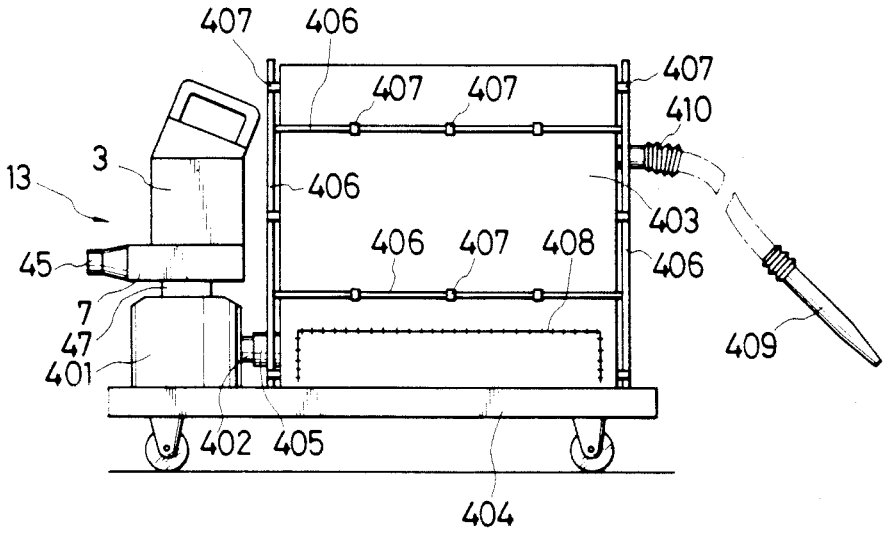

FIG. 16 shows another modification of a dust collecting case.

A suction chamber 401 is fixed to the suction mouth 47 with a screw. A suction pipe 402 is provided on a side of the suction chamber 401 to communicate with a dust collecting bag 403. A bottom of the suction chamber 401 is removably fitted to the suction chamber 401 by a fitting pin. A filter chamber similar to the filter chamber 354 shown in FIG. 15 is disposed inside the suction chamber 401 and connected to the suction mouth 47. The suction chamber 401 is arranged on a cart 404. A dust collecting bag 403 is located besides the suction chamber 401 and also arranged on the cart 404. A connection pipe 405 provided to the dust collecting bag 403 engages and communicates with the suction pipe 402 through a filter disposed inside the connection pipe 405. A supporting frame 406 is arranged around the dust collecting bag 403 to support the bag 403 with a number of fitting portions 407 which are fitted to the bag 403. A fastener 408 is provided on a side of the dust collecting bag 403 to take out the dust collected in the bag 403, as and when required. A rigid dust suction pipe 409 is provided on an upper part of the dust collecting bag 403 via a flexible pipe 410.

The supporting frame 406 may be formed in a cylindrical shape. The dust collecting bag 403 may be received in a rigid dust collecting case and provided with a supporting member which will be disposed inside the dust collecting bag 403. The rigid dust collecting case will be provided with an open/close cap at a top or a bottom of the dust collecting case, or divided into upper and lower portions to be opened and closed. Rollers may be attached directly to the dust collecting case instead of using the cart, or the dust collecting case may be put on the ground without using the rollers or the cart.

FIGS. 17 to 20 show still another modification of a dust collecting case.

A dust collecting case 453 comprises a cylindrical first case 459, a cylindrical second case 461, a cylindrical third case 463, and a cylindrical fourth case 465 which are piled up sequentially and fitted with one another such that the dust collecting case 453 as a whole can expand and contract. An upper opening 455 of the first case 459 engages with a periphery of the suction mouth 47. Namely, fitting pins 467 projecting outwardly from the periphery of suction mouth 47 engage with fitting grooves 469 formed at the opening 455 of the first case 459 to fix removably the dust collecting case 453 to the casing 13. An inner circumference of the second case 461 engages with the periphery of first case 459. Namely fitting pins 471 projecting outwardly from the periphery of first case 459 engage with fitting grooves 473 formed on the second case 461. Similarly, the third case 463 and the fourth case 465 are sequentially engaged. A suction port 475 is opened at a front side of the fourth case 465 and communicates with a suction pipe (not shown) through a flexible pipe 477. A filter 457 covers the suction mouth 47.

Figure 20:
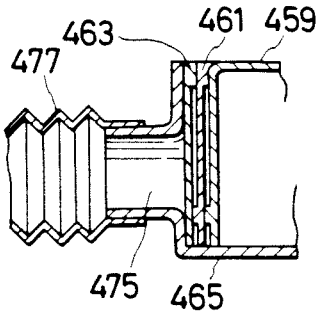
Figure 19:
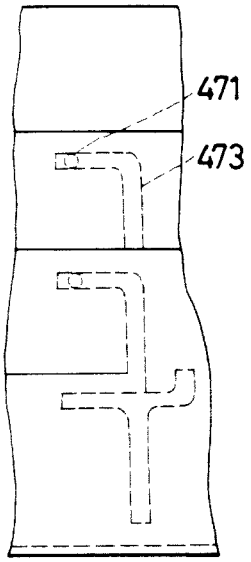

For storing the dust collecting case 453, the pins 467 are moved along the fitting grooves 469 to separate the suction mouth 47 from the opening 455. Pins 471 of the first case 459 are moved along the grooves 473 of the second case 461 to insert the first case 459 into the second case 461. Similarly, the second case 461 is received in the third case 463, and the third case 463 in the fourth case 465. As a result, a compact storing state is realized as shown in FIG. 20.

Figure 17:
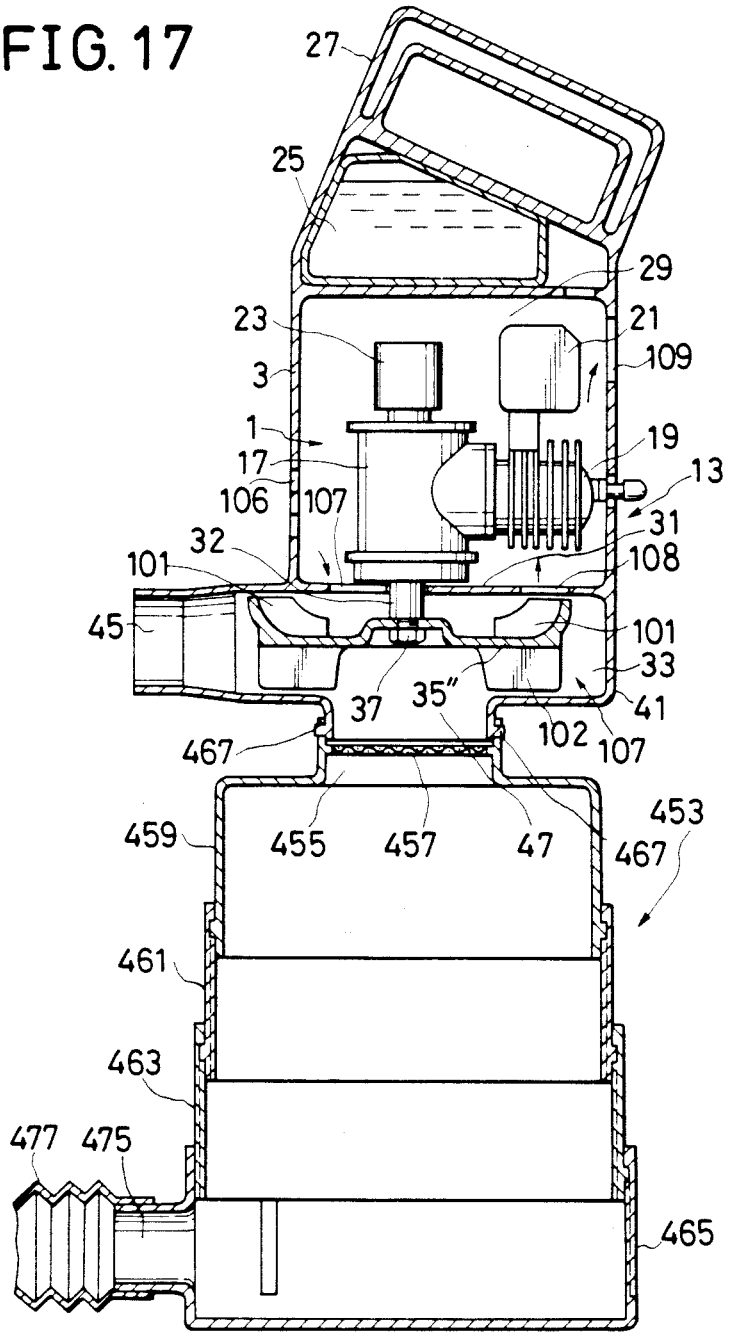
Figure 18:
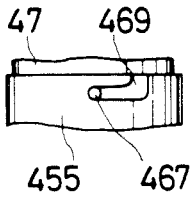
Figure 21:
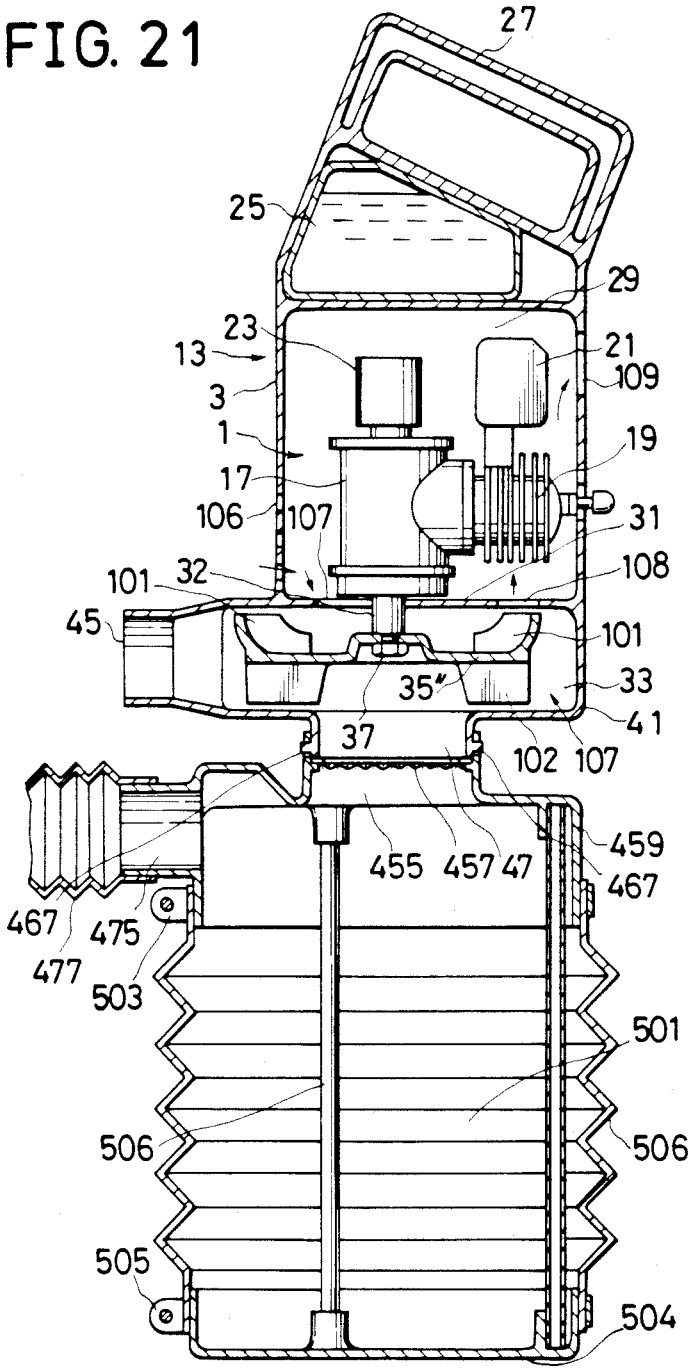

FIG. 21 shows a modification of the dust collecting case 453 shown in FIG. 17.

A bellows-like dust collecting case 501 made of soft synthetic resin, etc., is fixed to the first case 459 with a fastening band 503. The first case 459 is engaged with the casing 13. A bottom plate 504 is engaged with a lower part of the dust collecting case 501 with a fastening band 505. A plurality of supporting bars 506 are disposed between the first case 459 and the bottom plate 504 to prevent the dust collecting case 501 from contracting due to the sucking operation of the dust.

A ninth embodiment of the present invention will be described with reference to FIG. 22. In this embodiment, the blower is used both for blowing and sucking the dust on the ground.

A blower pipe 551 is fixed to the discharge mouth 45 through the flexible pipe 49. A dust collecting case 553 is removably fitted to the suction mouth 47 by a screw 555. A bottom 556 of the dust collecting case 553 has an opening 557, and is removably connected to the dust collecting case 553 by fitting pins 561. A dust suction pipe 559 passes through the bottom 556. A filter chamber 563 is positioned to face the suction mouth 47. Vent holes 565 are provided around the filter chamber 563. An annular porous filter 567 is disposed around the vent holes 565. A bottom of the filter chamber 563 is provided at a position facing an upper end of the dust suction pipe 559 with a guide portion 569 to guide sucked air outwardly and downwardly.

In operation, the blower fan 5 is rotated according to the rotation of the engine 1. An operator carries the casing 13 by the grip handle 27 with one hand, and with the other hand grasps the blower pipe 551 to blow the dust on the ground by air blown from a front end of the blower pipe 551. Atmosphere is sucked through the opening 557, enters into the filter chamber 563 through the filter 567 and the vent holes 565, is sent to the blower fan 5 through the suction mouth 47, and discharged from the front end of blower pipe 551 through the discharge mouth 45.

To suck the dust on the ground, a lower end of the dust suction pipe 559 is brought close to the ground. The sucked dust is guided downwardly by the guiding portion 569 in the dust collecting case 553. Large dust is collected on the bottom of dust collecting case 553, while small dust is separated by the filter 567. The dust collected in the dust collecting case 553 is removed by opening the bottom 556 after finishing the dust collecting work.

Figure 22:
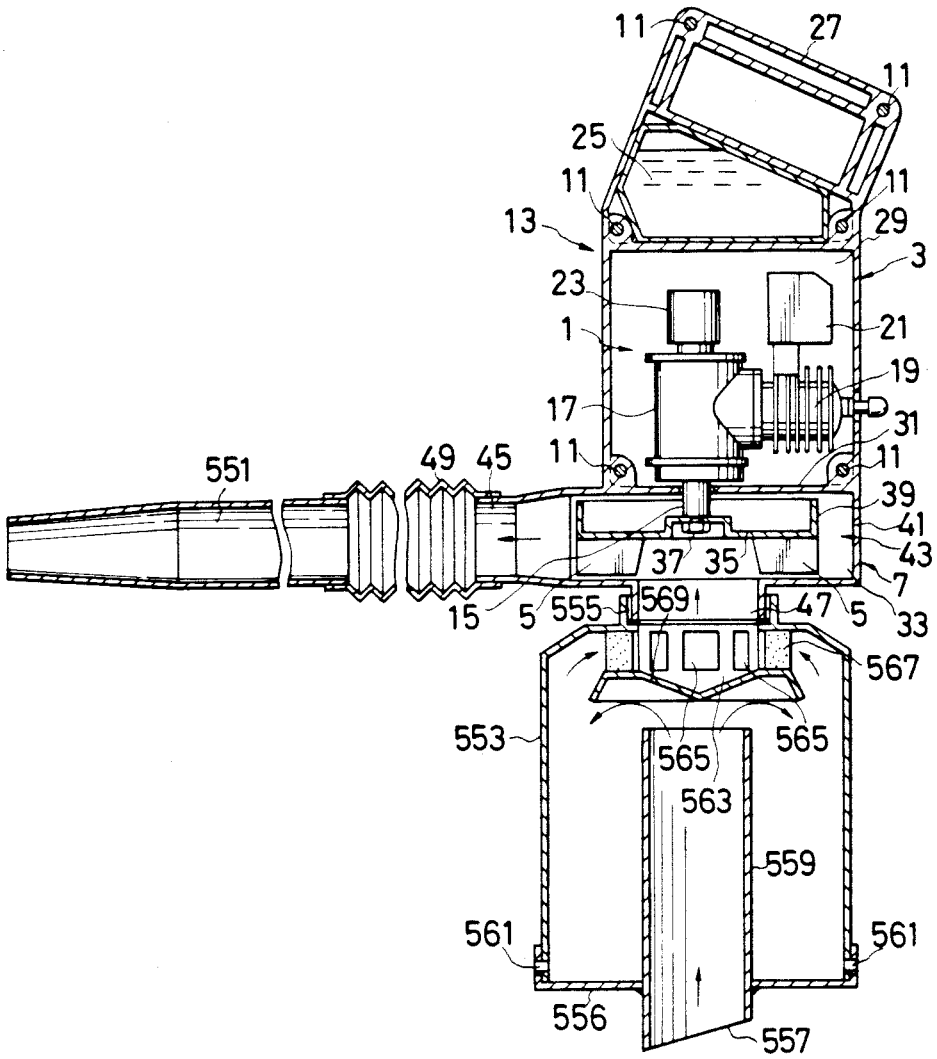
FIG. 22 is a cross-sectional side view showing a portable blower according to a ninth embodiment of the present invention.
Figure 23:
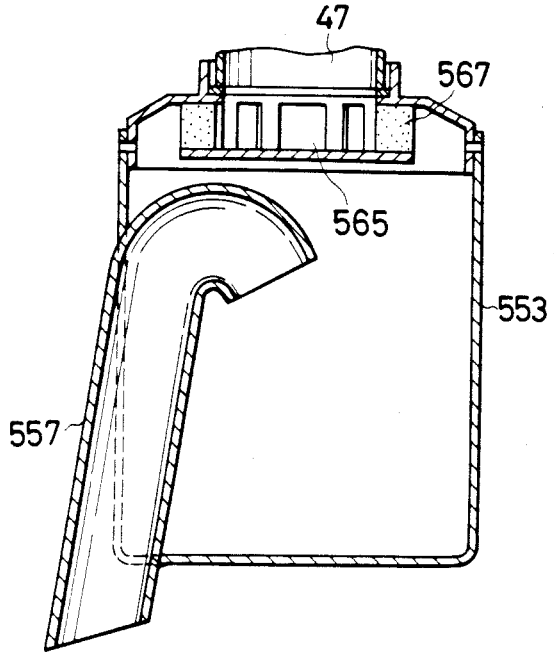
FIGS. 23 and 24 are views showing essential portions of modifications of the ninth embodiment.

FIG. 23 shows a modification of the dust suction pipe 557 shown in FIG. 22. In the modification, the dust suction pipe 557 is disposed at a side of the dust collecting case 553.

Figure 24:
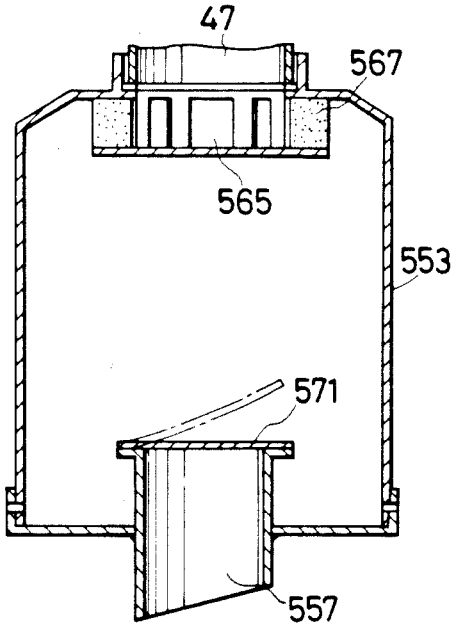

FIG. 24 shows another modification of the dust suction pipe 557 shown in FIG. 22. In the modification, the opening 557 is formed on the bottom 556 of the dust collecting case 553, and a check valve 571 is provided to an upper end of the dust suction pipe 559.

The dust suction pipe 559 may be constituted to recede in the dust collecting case 553 when the lower end of dust suction pipe 559 is pressed against the ground, and to emerge from the dust collecting case 553 when such a pressing force is removed. The bottom of dust collecting case 553 may be provided with rollers to roll on the ground if the dust collecting case 553 is large and heavy. The dust collecting case 553 may have an opening on its side wall to receive the dust suction pipe 559, and a check valve may be provided at the opening formed on the side wall. The filter chamber 563 may be filled with a filtering material to pass air from the dust collecting case 553 to the suction mouth 47 through the filter chamber 563. A permeable dust collecting bag may be inserted in the dust collecting case 553 such that the collected dust will be removed together with the bag.

According to the above arrangement, it is possible to blow the dust on the ground by the blower pipe 551, and, at the same time, to suck the dust on the ground by the suction pipe 559, as and when required.

Figure 25:
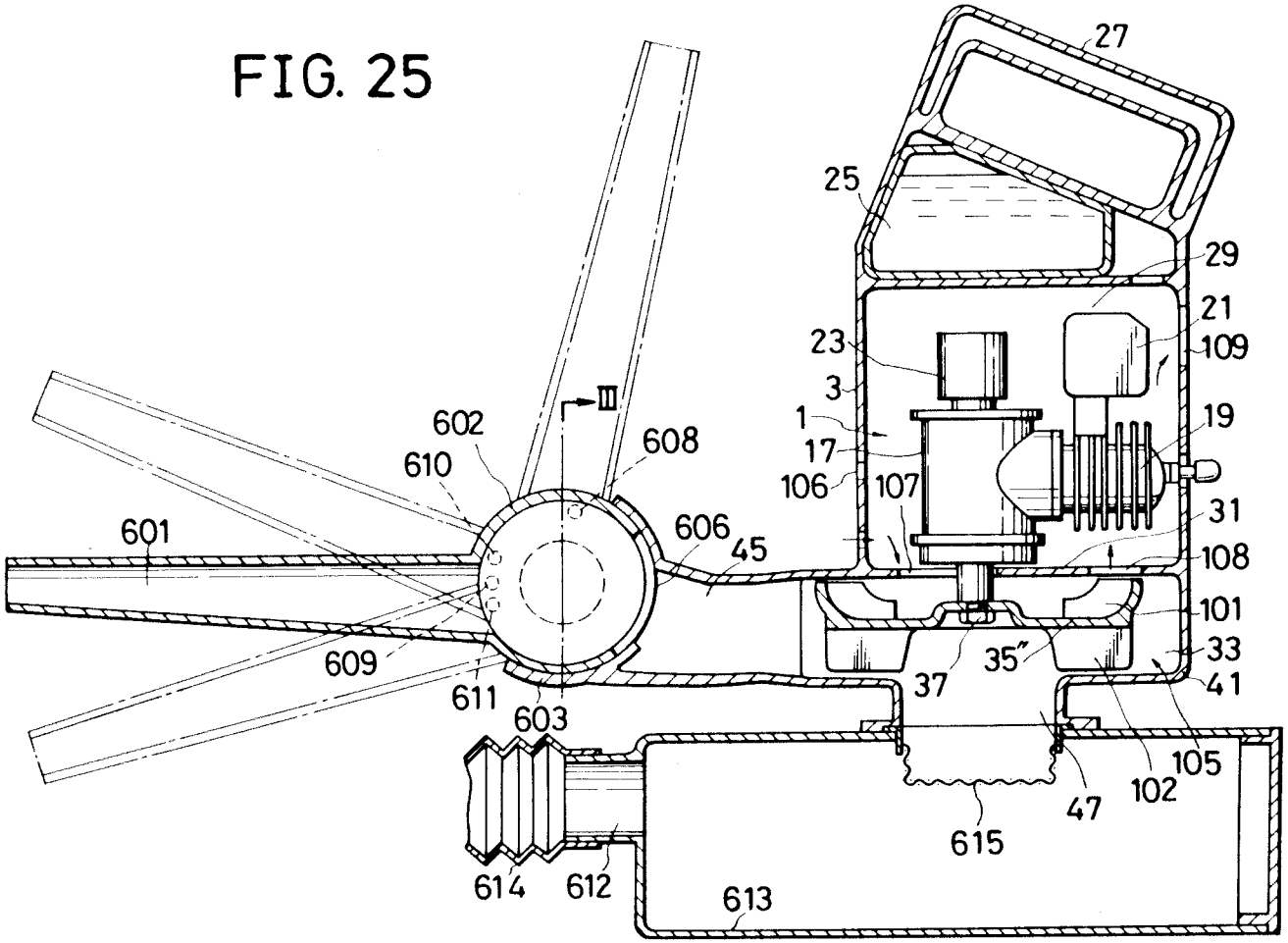
FIG. 25 is a cross-sectional side view showing a portable blower according to a tenth embodiment of the present invention.
Figure 26:
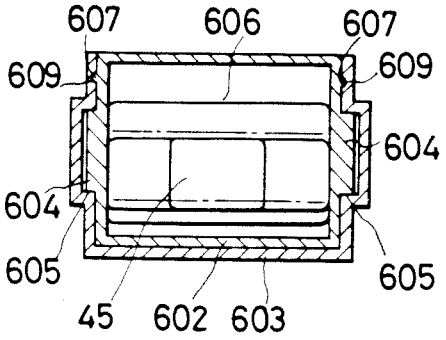
FIG. 26 is a cross-sectional front view showing an essential portion of the tenth embodiment.

A tenth embodiment of the present invention will be described with reference to FIGS. 25 to 26.

One end of a blower pipe 601 is pivotally connected to the discharge mouth 45 through a cylindrical portion 602. Namely, the cylindrical portion 602 which is orthogonal to the discharge mouth 45 engages with a semicylindrical recess of a supporting portion 603 which is fixed to the discharge mouth 45. Shaft portions 604 projecting outwardly from both sides of the cylindrical portion 602 engage with bearing portions 605 which are recessed on both sides of the supporting portion 603. A hole 606 is formed on the cylindrical portion 602 which communicates with the discharge mouth 45 when the blower pipe 601 is in a horizontal position. When the blower pipe 601 is in a vertical storing position, the hole 606 does not communicate with the discharge mouth 45. Semispherical projections 607 are formed on peripheries of both side surfaces of the cylindrical portion 62. Corresponding to the semispherical projections 607, semispherical receses 608, 609, 610, and 611 are formed on inner side faces of the supporting portion 603. The projections 607 are removably engaged with the recesses 608, 609, 610, and 611 so that the blower pipe 601 takes a vertical storing position, a horizontal position, an upper inclined position, and a lower inclined position respectively.

To blow the dust on the ground, the projections 607 are engaged with the recesses 609 to bring the blower pipe 601 to a horizontal position. Air from the blower fan 102 passes through the discharge mouth 45 and the hole 606, and is blown from a nozzle of the blower pipe 601 through the cylindrical portion 602.

To suck the dust on the ground, the projections 607 are engaged with the recesses 608 to bring the blower pipe 601 to a vertical position and to close the hole 606. The dust on the ground is sucked by a suction pipe (not shown) connected to a suction port 612 of a dust collecting case 613 through a flexible pipe 614, filtered by a filter 615, and collected in the dust collecting case 613.

Figure 27:
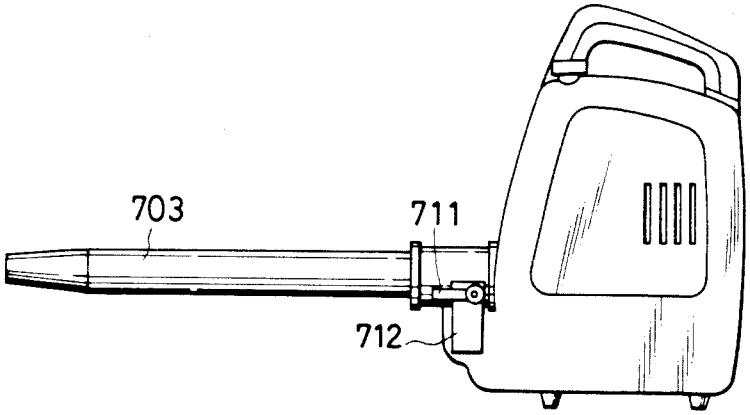
FIGS. 27 and 28 are a side view and a cross-sectional side view respectively showing a portable blower according to an eleventh embodiment of the present invention.
Figure 28:
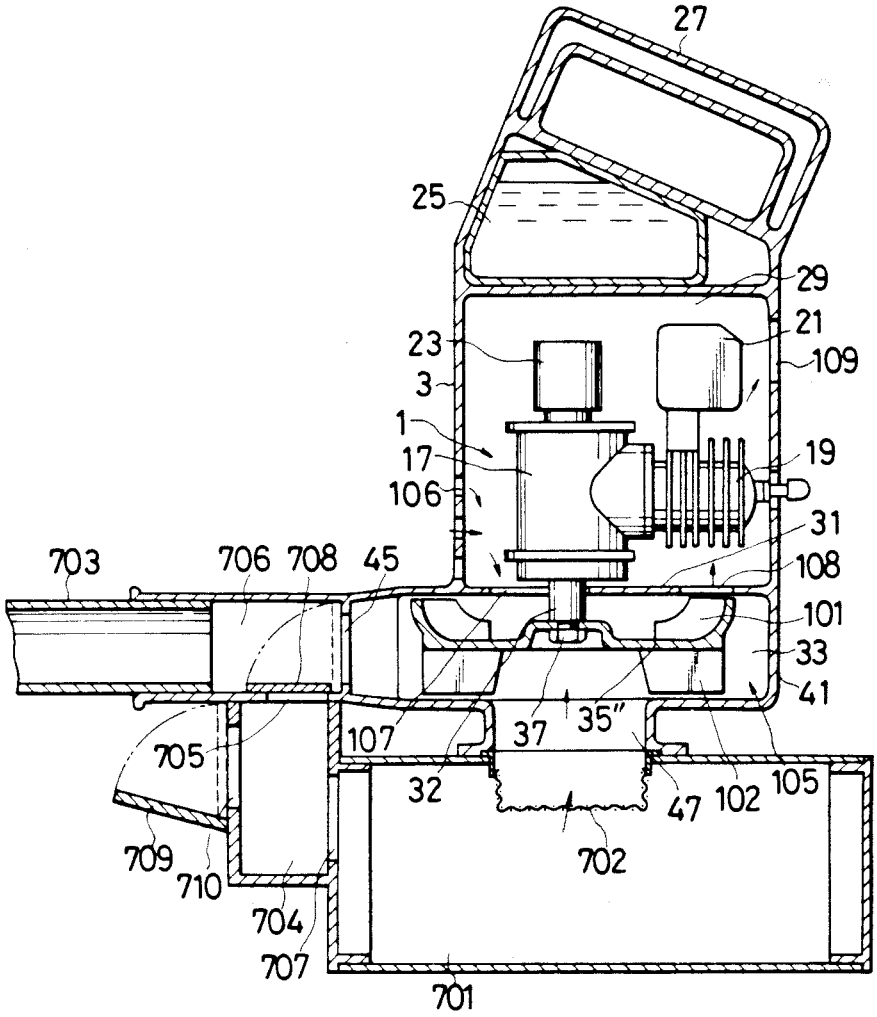

An eleventh embodiment of the present invention will be described with reference to FIGS. 27 and 28. In this embodiment, the blower can be used both for sucking and blowing the dust on the ground with a single blower pipe.

A dust collecting portion 701 is disposed under the suction mouth 47 and communicates with it through a filter 702. A blower pipe 703 is connected to the discharge mouth 45 and communicates with the working air passage 105. A suction circuit 704 communicates through an opening 705 with a discharge circuit 706 which is orthogonal to the suction circuit 704. The discharge circuit 706 is continuous from and aligned with the discharge mouth 45. The suction circuit 704 communicates witih the dust collecting portion 701 through a dust suction mouth 707. A selector valve 708 closes selectively the discharge mouth 45 and the opening 705. A shutoff valve 709 opens and closes an opening 710 which provides communication between atmosphere and the suction circuit 704. A lever 711 operates interlockingly through a linkage 712 the selector valve 708 and the shutoff valve 709 such that the suction circuit 704 is communicated with atmosphere when the blower pipe 703 is connected to the discharge circuit 706, and, when the blower pipe 703 is connected to the suction circuit 704, the suction circuit 704 is closed against atmosphere.

In the blowing operation, the lever 711 is operated to open the opening 710 by the shutoff valve 709 and close the opening 705 by the selector valve 708, and then the dust on the ground is blown by air which is sucked from the opening 710 according to a rotation of the blower fan 102, enters into the dust collecting portion 701 through the suction circuit 704 and the dust suction mouth 707, and is discharged from the blower pipe 703 through the working air passage 105, discharge mouth 45, and the discharge circuit 706.

In the sucking operation, the lever 711 is operated to close the opening 710 by the shutoff valve 709 and to open the opening 705 by the selector valve 708, and then the dust on the ground is sucked together with air from the blower pipe 703, enters into the dust collecting portion 701 via the opening 705, the suction circuit 704, and the dust suction mouth 707. The dust is filtered by the filter 702, and air is discharged through the filter 702, a gap between the rotary plate 35'' and the partition wall 31, the hole 108, and the hole 109.

Due to the above arrangement, the dust blowing work and the dust sucking work can be performed with the single blower pipe 703.

Figure 29:
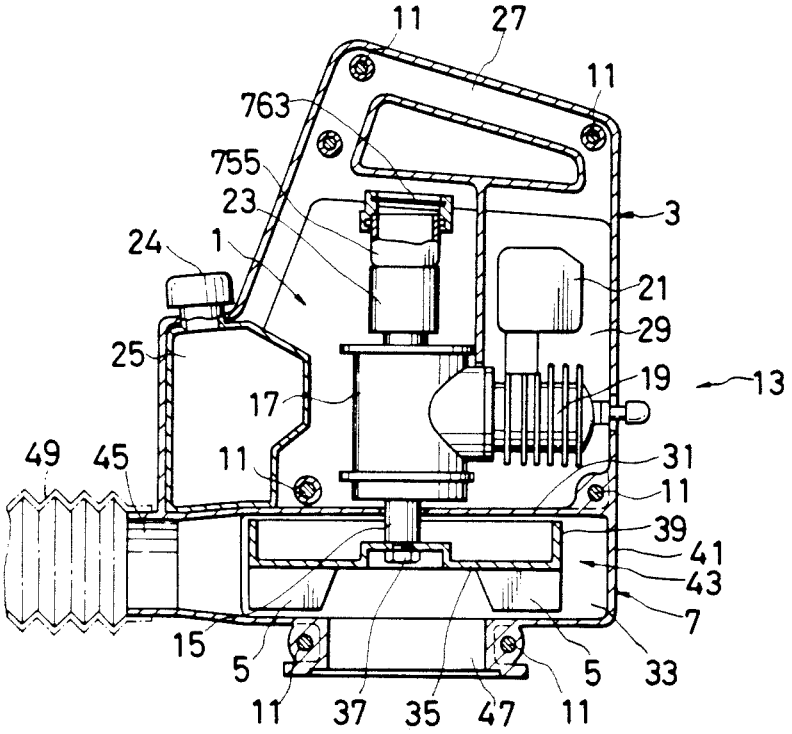
FIG. 29 is a cross-sectional side view showing a portable blower according to a twelfth embodiment of the present invention.
Figure 30:
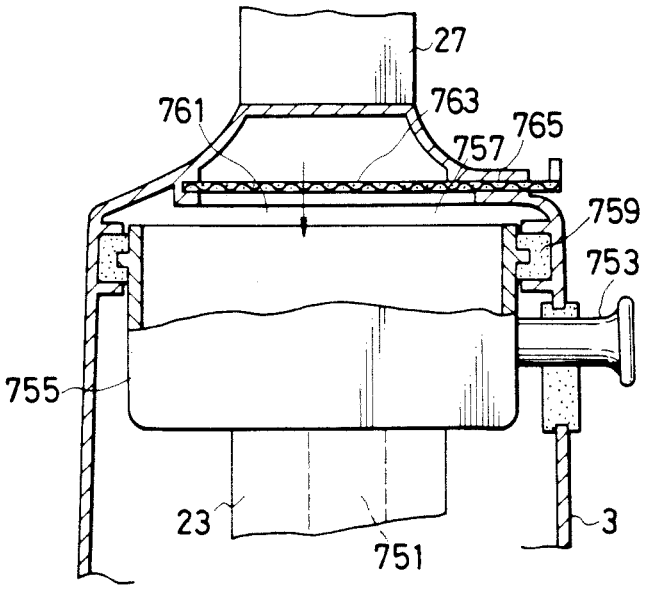
FIGS. 30 and 31 are views showing essential portions of the twelfth embodiment.
Figure 31:
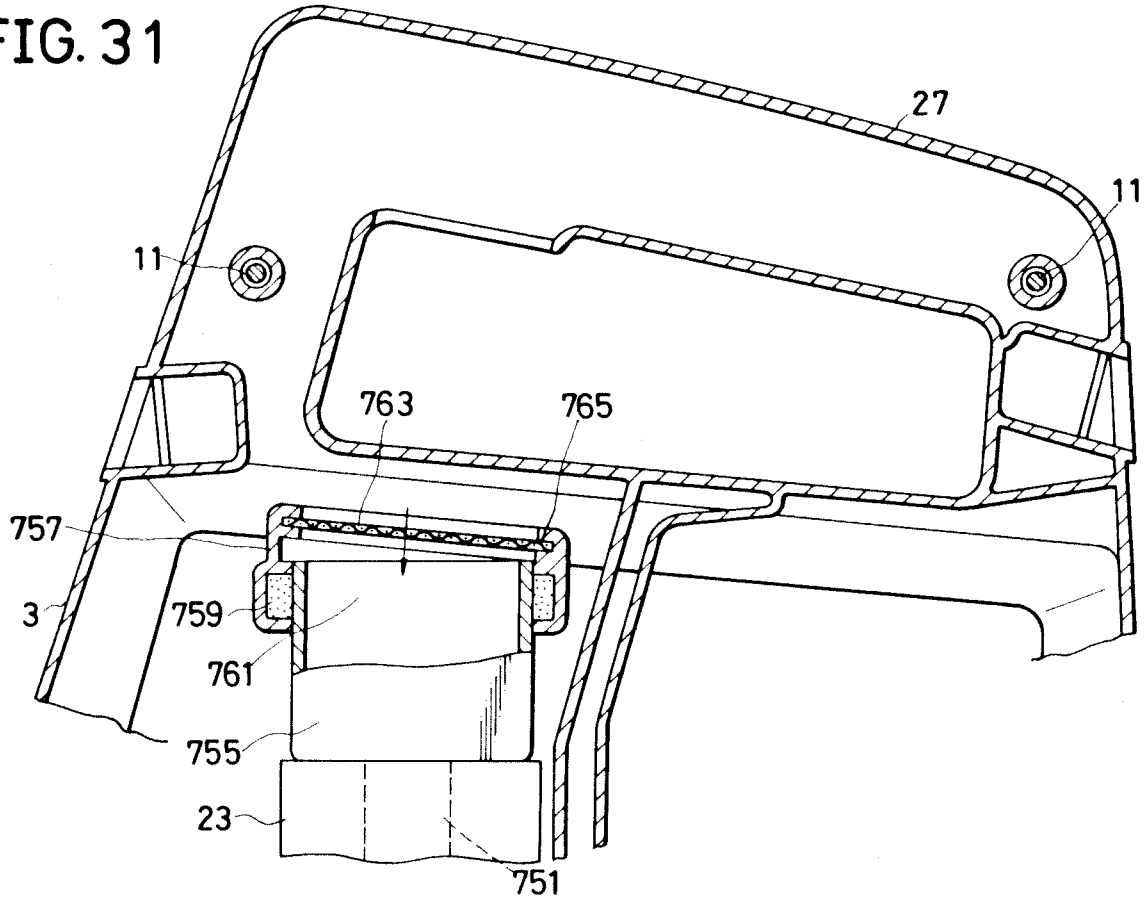

A twelfth embodiment of the present invention will be described with reference to FIGS. 29 to 31.

In this embodiment, the fuel tank 25 is disposed in front of the engine 1 inside the engine casing 3.

A choke case 755 incorporating a choke valve (not shown) which is opened and closed by a choke handle 753 is fixed to a suction port 751 which is disposed and opened on an upper surface of the carburetor 23. A filter case 757 is formed integrally with the engine casing 3 and can be divided together with the engine casing 3 into a right half and a left half. The choke case 755 is supported by the filter case 757 through a rubber buffer pad 759. An airflow passage 761 communicates with the suction port 751 through the choke case 755. A net-like flat filter 763 is disposed perpendicular to the airflow passage 761 and in the filter case 757. The filter 763 engages with a groove 765 and is removed therefrom by pulling the filter 763 in a direction perpendicular to the airflow passage 761.

Due to the above arrangement, the filter 763 can easily be taken out of the filter case 757 without interfering with the handle 27, and cleaned.

A thirteenth embodiment of the present invention will be described with reference to FIGS. 32 to 35. This embodiment relates to hooking portions of a shoulder band of the blower.

Figure 32:
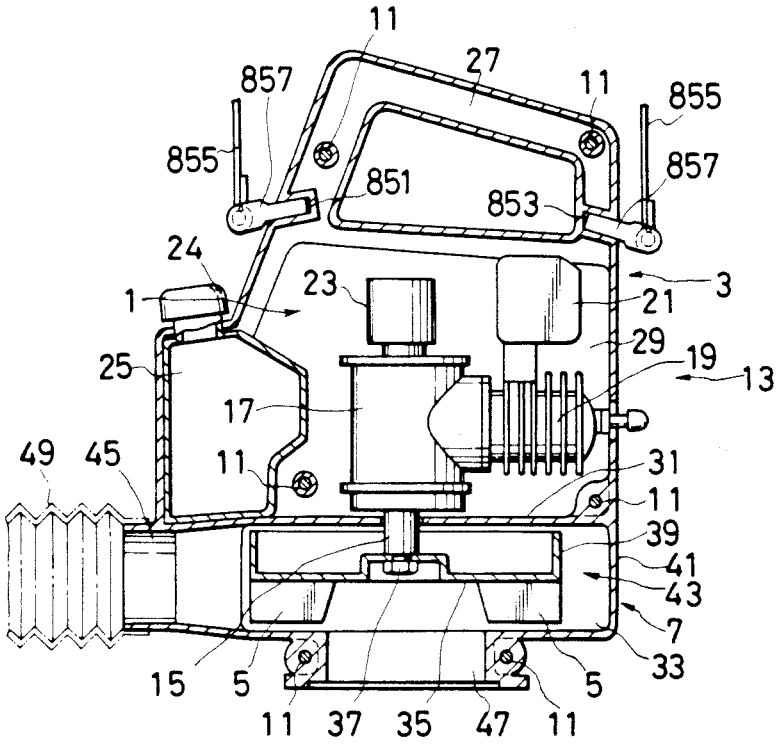
FIG. 32 is a cross-sectional side view showing a portable blower according to a thirteenth embodiment of the present invention.
Figure 33:
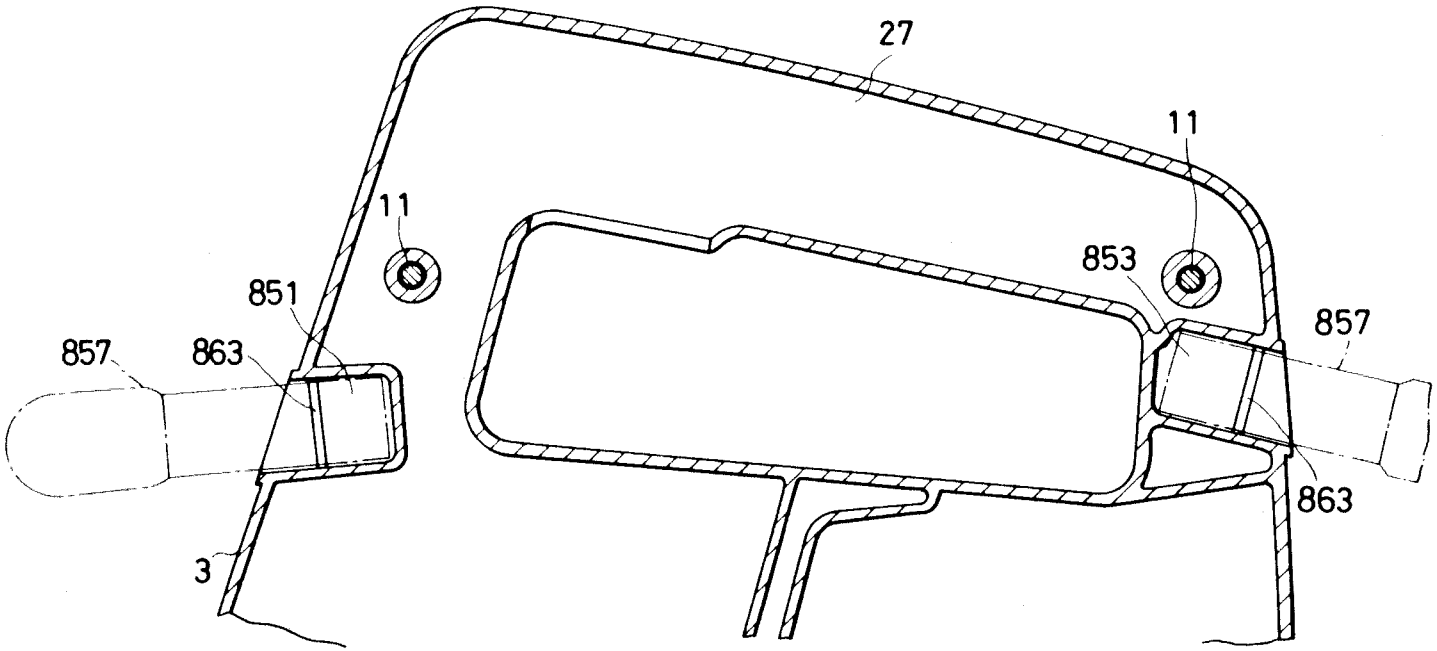
FIGS. 33 to 35 are views showing essential portions of the thirteenth embodiment.
Figure 34:
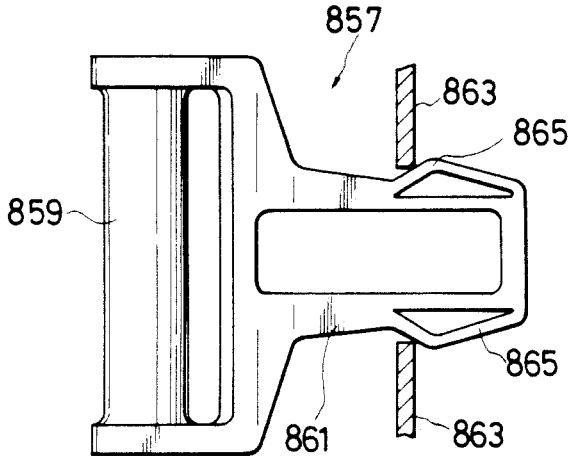
Figure 35:
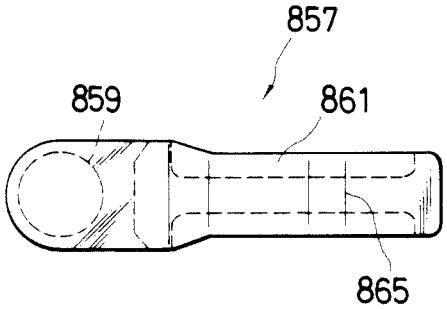

In FIG. 32, the oil tank 25 is disposed in the engine chamber 29 and in front of the engine 1. Hook holes 851 and 853 are provided at an upper part of the engine casing 3. The hook holes 851 and 853 are opened on the front side and the rear side of the engine casing 3 respectively, and inclined upwardly toward the inside of the engine casing 3. Hooks 857 connected to a shoulder band 855 are inserted into the hook holes 851 and 853 respectively. One end of each hook 857 is provided with a shaft 859 to which one end of the shoulder band 855 is wound, and the other end of each hook 857 is provided with an engaging portion 861 which is engaged with the hole 851 or 853. On both sides of the engaging portion 861, there are provided engaging nails 865 which project outwardly and engage removably with engaging portions 863 which are formed inside the holes 851 and 853. Front and rear portions of each engaging nail 865 are slanted.

When the shoulder band 855 is not required, the hooks 857 are pulled strongly out of the hook holes 851 and 853 such that the slanted faces of engaging nails 865 are pressed by the engaging portions 863 to remove the engaging nails 865 from the engaging portions 863. When the shoulder band 855 is required, the hooks 857 are are strongly inserted into the hook holes 851 and 853 respectively such that the slanted faces of the engaging nails 865 are pressed against the engaging portions 863 to engage the engaging nails 865 with the engaging portions 863.

Figure 36:
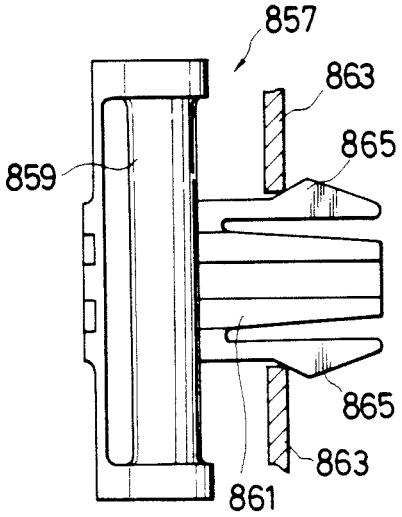
FIGS. 36 to 43 are views showing essential portions of modifications of the thirteenth embodiment.
Figure 37:
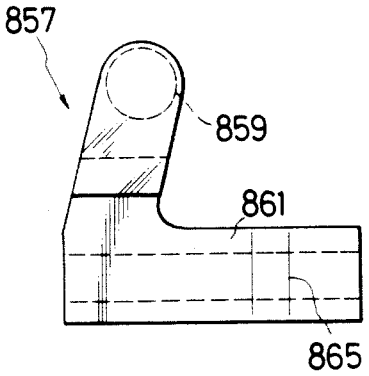

FIGS. 36 and 37 show a modification of the hooks 857 shown in FIG. 32. In this modification, the hooks 857 are bent upwardly, and the shafts 59 are positioned at the upper part of the hooks 857.

Figure 38:
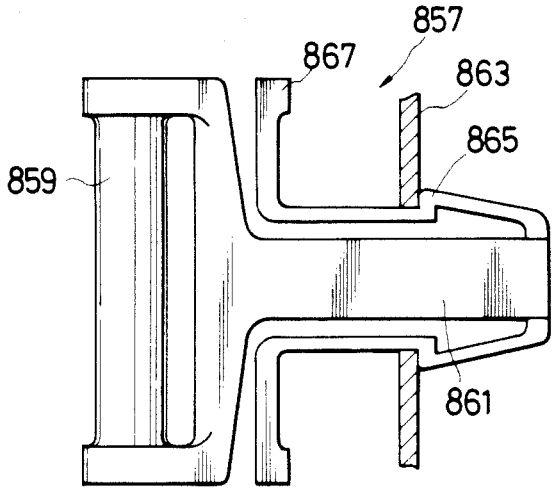
Figure 39:
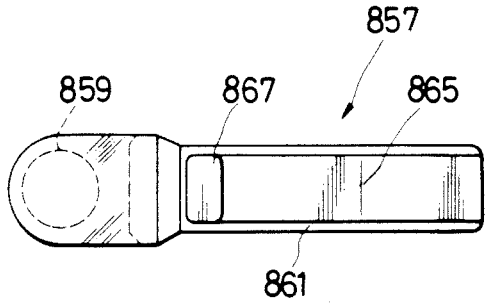
Figure 40:
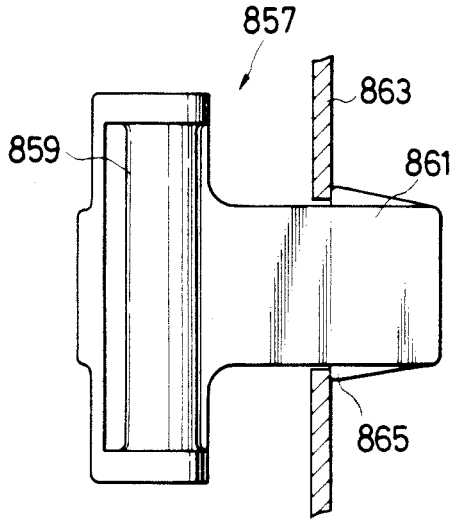
Figure 41:
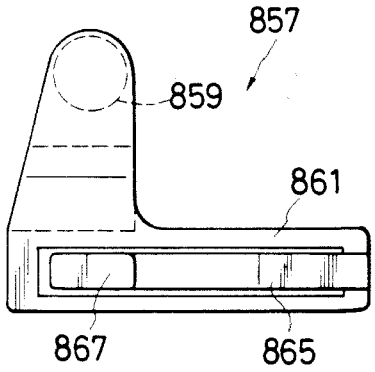
Figure 42:
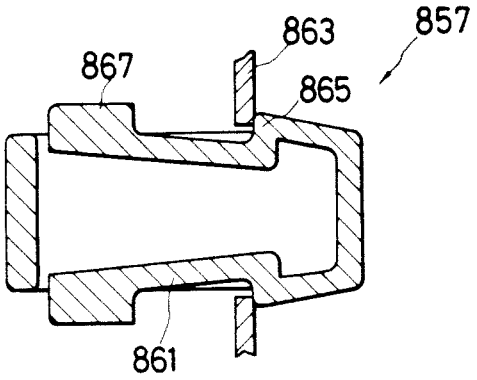
Figure 43:
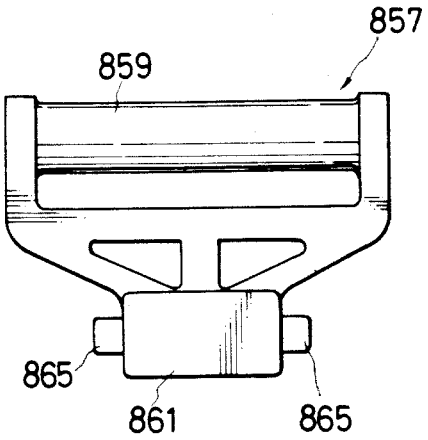

FIGS. 38 and 39 show another modification of the hooks 857 shown in FIG. 32. In this modification, operation pieces 867 for engaging and releasing the engaging nails 865 are provided on both sides of the engaging portion 861 of each hook 857.

FIGS. 40 to 43 show the other modification of the hooks 857 shown in FIG. 32. In this modification, the fitting nails 865 recede in and emerges from both sides of the engaging portion 861 of each hook 857, and operation pieces 867 for causing the recede and emerge of the engaging nails 865 are provided on both sides of the engaging portion 861 of each hook 857.

According to the above arrangements shown in FIGS. 32 to 43, the shoulder band 855 will easily be attached to or removed from the blower. When the shoulder band 855 is removed from the blower, the blower has no projecting hooks so that the blower will not catch the clothes, etc., of an operator of the blower.

What is claimed is:

1. A portable blower comprising:

a casing provided with a handle and including therein an engine chamber and a fan chamber, said fan chamber being arranged under said engine chamber with a partition wall between them and having a suction mouth and a discharge mouth;

an engine and a fuel tank which are arranged within said engine chamber, said engine comprising a horizontally disposed engine cylinder, a crankcase, a cantilever-type crank shaft, a carburetor, and a muffler; and a blower fan and an air passage which are arranged within said fan chamber, said air passage connecting said suction mouth with said discharge mouth to provide communication between them, wherein said crankcase is disposed laterally adjacent to said engine cylinder and connected thereto, said crank shaft extending downwardly from said crankcase into said fan chamber through said partition wall, said carburetor being disposed above said crankcase and connected thereto, said muffler being disposed above said engine cylinder and connected thereto, and said blower fan being fixed to a lower end of said crank shaft and driven by said engine to suck air from atmosphere and blow air to atmosphere.

2. A portable blower as claimed in claim 1, comprising further a dust collecting unit which comprises:

a dust collecting case for collecting dust therein, having an open bottom and connected removably to said suction mouth;

a dust suction pipe for sucking dust and for sending the sucked dust into said dust collecting case, said dust suction pipe being connected removably to said dust collecting case;

a filter chamber arranged in said dust collecting case and communicating with said suction mouth, said filter chamber being provided with a filter for preventing the sucked dust from entering into said suction mouth;

a dust collecting bag for receiving the dust collected in said dust collecting case, said dust collecting bag being fitted removably to cover said open bottom of the dust collecting case; and a supporting frame inserted inside said dust collecting bag and fixed to a lower part of said dust collecting case such that said dust collecting bag will not be deformed even if a negative pressure is caused inside said dust collecting case.

3. A portable blower as claimed in claim 2, wherein said supporting frame is arranged outside said dust collecting bag and fixed to a lower part of said dust collecting case.

4. A portable blower as claimed in claim 3, wherein said supporting frame is formed in a cylindrical shape having an open top and a closed bottom, said open top being fixed to a lower part of said dust collecting case.

5. A portable blower as claimed in claim 4, comprising further an additional filter disposed between said dust collecting case and said dust collecting bag, wherein said dust suction pipe is connected to and communicated with said dust collecting bag instead of said dust collecting case.

6. A portable blower as claimed in claim 5, comprising further a cart on which said dust collecting unit is loaded.

7. A portable blower as claimed in claim 3, wherein said supporting frame comprises a plurality of annular members having different diameters respectively such that said supporting frame will telescopically be extended and contracted.

8. A portable blower as claimed in claim 3, wherein said supporting frame comprises a bellows and supporting bars, said bellows being expanded if said supporting bars are inserted into said bellows, and contracted if said supporting bars are removed.

9. A portable blower as claimed in claim 1, comprising further;

a blower pipe for blowing dust, said blower pipe being connected to said discharge mouth through a flexible pipe; and a dust collecting unit which comprises:

a dust collecting case for collecting dust therein, having an open bottom;

a bottom plate removably fitted to said open bottom of the dust collecting case;

a dust suction pipe for sucking dust and for sending the sucked dust into said dust collecting case, said dust suction pipe being fixed to said bottom plate and extending through said bottom plate such that an upper end of said dust suction pipe is located within said dust collecting case and a lower end of said dust suction pipe is located outside said dust collecting case; and a filter chamber arranged in said dust collecting case and communicating with said suction mouth, said filter chamber being provided with a filter for preventing the sucked dust from entering into said suction mouth.

10. A portable blower as claimed in claim 9, comprising further a check valve which is provided to said upper end of the dust suction pipe.

11. A portable blower as claimed in claim 2, comprising further:

a blower pipe for blowing dust;

a cylindrical portion formed integrally at a rear end of said blower pipe;

a semicylindrical portion formed integrally at a front end of said discharge mouth of the blower, said semicylindrical portion receiving said cylindrical portion;

a pair of projections formed on said cylindrical portion; and a plurality of pairs of recesses for receiving removably said pair of projections, wherein said cylindrical portion is pivotal in said semicylindrical portion such that said blower pipe will take a vertical position where a front end of said blower pipe faces upward, a horizontal position, and other optional positions according to the engagement between said pair of projections and said plurality of pairs of recesses, wherein said blower pipe does not communicate with said discharge mouth when said blower pipe is in the vertical position and communicates with said discharge mouth when said blower pipe is not in the vertical position.

12. A portable blower as claimed in claim 1, comprising further;

a dust collecting portion disposed under said fan chamber and communicating with said fan chamber through said suction mouth;

a suction circuit communicating with said dust collecting portion and having a first opening which communicates with atmosphere as well as having a second opening;

a discharge circuit communicating with said suction circuit through said second opening as well as communicating with said discharge mouth of the blower through a third opening;

a blower pipe connected to said discharge circuit;

a selector valve disposed in said discharge circuit to open and close selectively said second and third openings;

a shutoff valve disposed at said first opening to open and close said first opening;

a lever disposed on an outer surface of said blower; and a linkage connected to said lever and said selector and shutoff valves, for operating interlockingly said selector and shutoff valves by said lever, wherein said linkage is constituted such that, when said lever is operated for the blowing operation, said first opening is opened by said shutoff valve, and said second opening closed and said third opening opened both by said selector valve simultaneously, and, when said lever is operated for the sucking operation, said first opening is closed by said shutoff valve, and said second opening opened and said third opening closed both by said selector valve simultaneously.

* * * * *